United States Patent [19]

Trachte

[11] Patent Number: 4,580,728

[45] Date of Patent: Apr. 8, 1986

[54] FUEL INJECTION NOZZLE FOR INTERNAL COMBUSTION ENGINES

[75] Inventor: Dietrich Trachte, Kornwestheim, Fed. Rep. of Germany

[73] Assignee: Robert Bosch GmbH, Stuttgart, Fed. Rep. of Germany

[21] Appl. No.: 597,100

[22] Filed: Apr. 5, 1984

[30] Foreign Application Priority Data

May 25, 1983 [DE] Fed. Rep. of Germany ..... 3318887

[51] Int. Cl.[4] ..... B05B 1/32

[52] U.S. Cl. ..... 239/453; 239/533.12

[58] Field of Search ... 239/453, 456, 459, 533.2–533.12

[56] References Cited

U.S. PATENT DOCUMENTS 4,356,977 11/1982 Hofmann ..... 239/533.9

4,410,141 10/1983 Seifert ..... 239/453

*Primary Examiner*—Andres Kashnikow

*Assistant Examiner*—Scott D. Malpede

*Attorney, Agent, or Firm*—Edwin E. Greigg

[57] ABSTRACT

A fuel injection nozzle having an outwardly opening valve needle to which a piston is connected and on which a cap is mounted. The cap encloses a damping chamber, which communicates in a throttled manner, via the play between the piston and the cap, with the flow course of the fuel. Oriented toward the cap is a blocking shoulder attached to the housing, which shoulder restrains the cap, after an undamped pre-stroke ($h_v$), relative to the valve needle, which continues to move, its continued movement being damped thereby. A spring acts via a spacer body upon the cap, the spacer body keeping the cap at a distance from the blocking shoulder corresponding to the pre-stroke ($h_v$) in the closing position of the valve needle. As a result, the prescribed set-point value of the pre-stroke ($h_v$) can be adhered to very precisely.

12 Claims, 3 Drawing Figures

FUEL INJECTION NOZZLE FOR INTERNAL COMBUSTION ENGINES

BACKGROUND OF THE INVENTION

The invention is based on a fuel injection nozzle for internal combustion engines. In these injection nozzles, the opening movement of the valve needle after the undamped pre-stroke is retarded or damped by providing that the fuel can subsequently flow into the damping chamber, which at that time is enlarging, only in a throttled manner. Upon the closing stroke of the valve needle, care is taken that the valve needle can return quickly to its closing position without being hindered by the damping means. The undamped pre-stroke is attained by providing that in the closing position of the valve needle the cap surrounding the damping chamber rests on the front end of the piston-like extension of the valve needle, and the length of the extension is selected such that the cap is spaced apart by a distance corresponding to the undamped pre-stroke from the blocking shoulder oriented toward this cap and attached to the housing. During the opening stroke of the valve needle, the cap is at first able to follow the valve needle in an unhindered manner, until it strikes the blocking shoulder. This arrangement is very simple and is attainable in some cases without additional parts. However, the distance between the cap and the blocking shoulder of the housing in the closing position of the valve needle is affected by a multiplicity of dimensional tolerances, so that an exact adherence to the set-point value of the undamped pre-stroke necessitates a very high manufacturing accuracy of relatively many parts, or else necessitates additional provisions for adjustment.

OBJECT AND SUMMARY OF THE INVENTION

The apparatus according to the invention has the advantage over the prior art that with simple means which can already be applied when the injection nozzle is assembled, the desired length of the undamped pre-stroke can be adhered to precisely. The actual length of the pre-stroke is now determined only by the dimensional tolerances between the support shoulders on the spacer body and counterpart shoulders and end-edge shoulders of the cap.

A simple spacer body which requires little raw material is attained when the spacer body is embodied as a ring having two sections of different diameters, at the transition between which the support shoulder associated with the counterpart shoulder of the cap is embodied. The section of the ring of larger diameter may advantageously project grippingly over a rim flange of the cap and be provided with a plurality of notches on the edge between which individual support tabs are embodied.

The cap can be embodied without a rim flange or any other circumferential shoulder if, in accordance with a further proposal of the invention, the spacer body is a sheath provided with a bottom, the depth of which is greater than the length of the cap by the length of the undamped pre-stroke.

The invention will be better understood and further objects and advantages thereof will become more apparent from the ensuing detailed description of two preferred embodiments taken in conjunction with the drawings.

DESCRIPTION OF THE EXEMPLARY EMBODIMENTS

Figure 1:
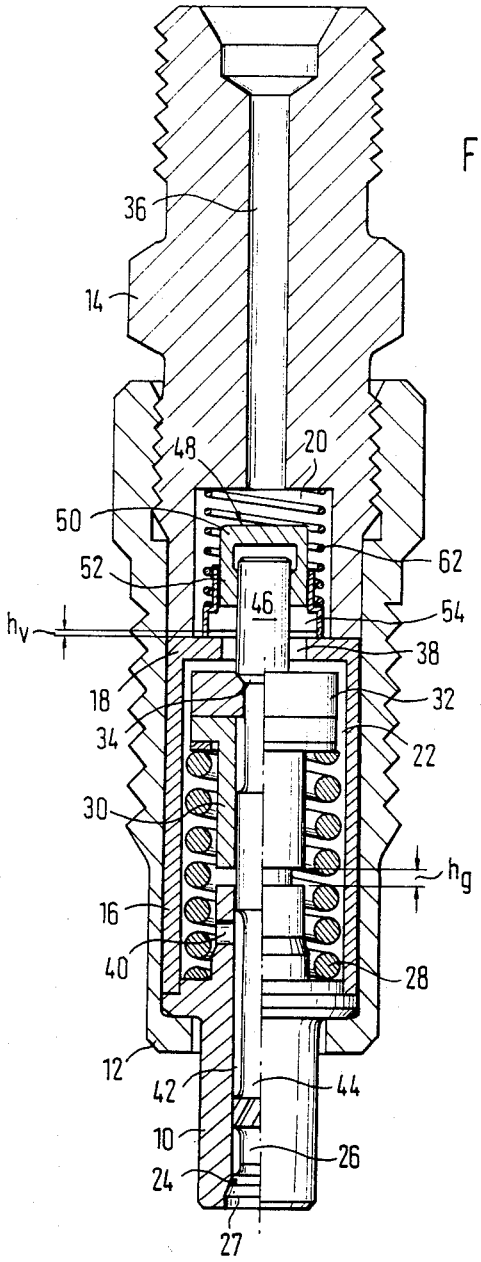
FIG. 1 shows an injection nozzle according to the first exemplary embodiment in longitudinal section.

The injection nozzle according to FIG. 1 has a nozzle body 10, which is fastened firmly to a nozzle holder 14 by a sleeve nut 12. A sheath 16 is disposed between the nozzle body 10 and the nozzle holder 14, having an inwardly oriented collar 18 which divides a chamber 20 from a chamber 22 of larger diameter in the interior of the injection nozzle. A valve seat 24 is formed in the nozzle body 10 and a valve needle 26 is displaceably supported therein, its sealing cone 27 being pressed against the valve seat 24 by a closing spring 28. The closing spring 28 is supported on the nozzle body 10 and via a flange part 30 engages a support disk 32, which is supported in turn on a shoulder 34 of the valve needle 26.

An inflow bore 36 is formed in the nozzle holder 14, discharging into the chamber 20, which communicates with the chamber 22 via an opening 38 surrounded by the collar 18. A bore 40 in the nozzle body 10 leads out of this chamber 22 into an annular chamber 42, which is formed between the central bore wall of the nozzle body 10 and the jacket circumference of a section 44 of reduced diameter of the valve needle 26 and extends directly to just prior to the valve seat 24. Between the flange part 30 and the nozzle body 10, a distance $h_g$ exists in the closing position shown, corresponding to the total stroke of the valve needle 26. The valve needle 26 is displaced outward in the opening direction by the fuel pressure, counter to the closing spring 28, until the flange part 30 strikes against the nozzle body 10. When the valve closes, the closing spring 28 returns the valve needle 26 inward, back into the closing position shown.

Figure 2:
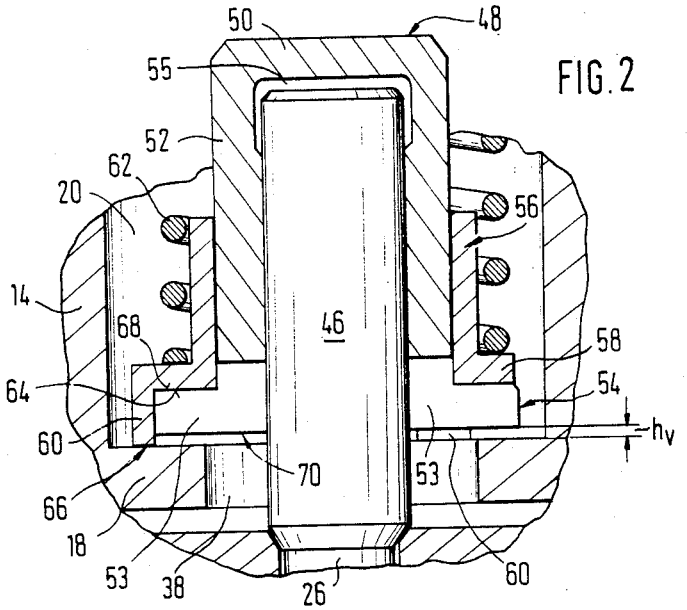
FIG. 2, on an enlarged scale, shows several individual parts of FIG. 1.

Adjoining the shoulder 34 of the valve needle 26 is a piston-like extension 46, which passes all the way through the opening 38 and protrudes into the chamber 20. The diameter of the extension suitably corresponds to the guide diameter of the valve needle 26. A cap 48 which has a bottom 50, a jacket part 52 and a flange rim 54 provided with a plurality of radial slits 53 shown by the unshaded area at the bottom of cap 48 (FIG. 2) is mounted upon the extension 46. Between the end face of the extension 46 and the bottom 50, a damping chamber 55 is formed in the cap 48, communicating in a throttled manner, via the radial play between the extension 46 and the jacket part 52 of the cap, with the flow course of the fuel.

A spacer ring 56 is pushed onto the jacket part 52 and is provided with a ring flange 58, on the outer circumference of which three axially directed support tabs 60 are uniformly distributed, projecting over and gripping the flange rim 54 of the cap 48. The ring flange 58 is engaged by a restoring spring 62 for the cap 48, which spring presses the spacer ring 56 with its support tabs 60 against the collar 18 of the sheath 16.

As a result of the described embodiment, the spacer ring 56 has two support shoulders 64 and 66 offset from one another in the axial direction, of which one, 64, is formed by the lower lateral face of the ring flange 58 and the other, 66, is formed by the end faces, all located in one common plane, of the support tabs 60. The support shoulder 64 is associated with a counterpart shoulder 68 on the cap 48, which is formed by the upper annular face of the flange rim 54. The lower lateral face of the flange rim 54 forms an end-rim shoulder 70, which is associated with the collar 18 serving as a blocking shoulder attached to the housing. The axial spacing between the support shoulders 64, 66 corresponds to the sum of the height of the flange rim 54 and the length of an undamped pre-stroke $h_v$.

In the illustrated closing position of the valve needle 26, the restoring spring 62 has placed the spacer ring 56 against the collar 18 and displaced the cap 48 toward the collar 18, thereby positively displacing fuel out of the damping chamber 55, that a gap corresponding to the undamped pre-stroke $h_v$ remains between the end-rim shoulder 70 of the cap 48 and the collar 18. As a result of the increasing fuel pressure at the beginning of an injection event, first the valve needle 26 in common with both the extension 46 and the cap 48 is displaced by the length of the pre-stroke $h_v$, the volume of the damping chamber remaining virtually unchanged and the valve needle movement taking place practically undamped.

At the end of the pre-stroke $h_v$, the cap 48 comes to rest on the collar 18, which prevents the cap 48 from then continuing to move when the valve needle 26 moves. During this continuing movement of the valve needle 26, either the pressure in the damping chamber 55 drops or the pressure increase in the damping chamber 55 takes place more slowly than in the chamber 20, so that the movement of the valve needle 26 is retarded or damped, until the flange part 30 strikes the nozzle body 10 and terminates the opening stroke. The fuel can flow practically unthrottled through the slits 53 in the cap 48 into the opening 38 and from there, as described above, can flow to the valve seat 24.

During the damped or retarded opening stroke of the valve needle 26, fuel is pressed into the damping chamber 55 by the radial play between the extension 46 and the jacket part 52 of the cap 48. During a closing movement of the valve needle 26, the cap 48 is carried upward as well because of the cushion of fuel that has flowed into the damping chamber 55, and the restoring spring 62 opposes the substantially stiffer closing spring 28 with only a relatively slight resistance. The restoring spring 62 is dimensioned such that the fuel quantity that has flowed into the damping chamber 55 from the beginning of the closing stroke of the valve needle 26 until the beginning of the next subsequent opening stroke is forced out of the damping chamber, except for a remnant volume, and the spacing ring 56 has again come to rest on the collar 18.

The cap 48 centers itself on the valve needle 26 and has a sufficiently large radial play relative to the nozzle holder 14 that the valve needle 26 can operate without seizing. The restoring spring 62 for the cap 48 extends partially beyond the cap 48, so that in this realization the means for partial damping of the opening stroke of the valve needle 26 require only a very little space in the axial direction of the injection nozzle.

With the apparatus described above it is possible to form a preliminary stream which practically from the injection onset on furnishes a constant injection quantity. If damping is designed to be suitably hard, a pronounced transition can be attained between the preliminary stream and the main stream. The apparatus described can also be suitably used with injection nozzles where the damping is rescinded even before the end of the valve needle stroke and thereby a main stream that is distinctly different in both quantity and intensity from a preliminary stream can be generated. In this case, an undamped pre-stroke of the valve needle can be suitably provided in order to prevent sluggish opening of the valve needle. The pre-stroke is determined only by the relationship between two parts and is not affected even if the position of the collar 18 varies, as may happen for instance if incorrect torque is applied to the sleeve nut 12, if there is plastic or elastic deformation of the nozzle holder 14 and the sheath 16, or in the event of other manufacturing tolerances.

Figure 3:
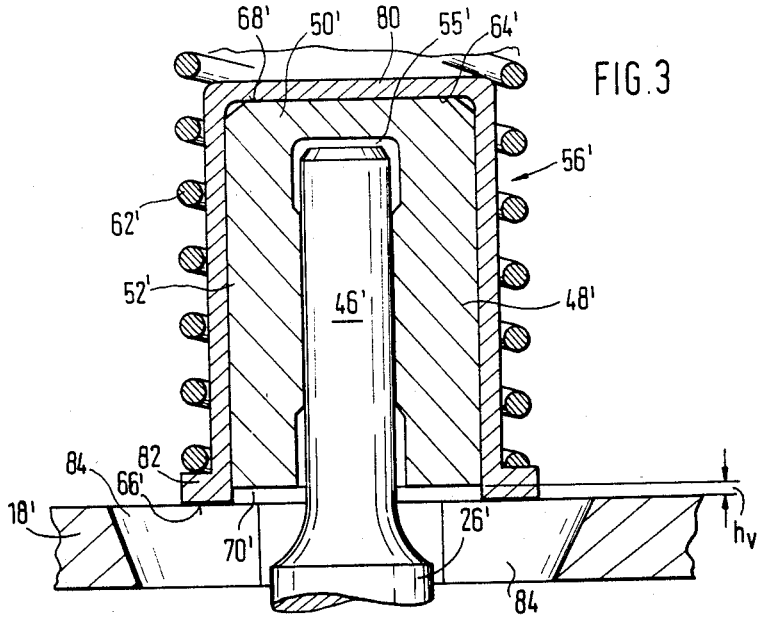
FIG. 3 shows the second exemplary embodiment in a view corresponding to FIG. 2.

In the exemplary embodiment of FIG. 3, a valve needle 26' is provided with a piston-like extension 46' of reduced diameter, on which a cap 48' is placed which has a smooth-cylindrical jacket part 52'. The spacer body here is a sheath 56' pushed onto the cap 48', its bottom 80 forming one support shoulder 64', which cooperates with the bottom 50' of the cap 48' acting as the counterpart shoulder 68'. The sheath 56' has a flange rim 82, which is engaged by the restoring spring 62' and which forms the second support shoulder 66', which is oriented toward the collar 18' attached to the housing. This collar 18' is provided with a plurality of local recesses 84 distributed over the circumference, through which the fuel can pass unhindered to reach the valve seat 24.

In the illustrated closing position of the valve needle 26', the damping chamber 55' formed between the cap 48' and the extension 46' has its smallest volume, and the end-rim shoulder 70' of the cap 48' oriented toward the collar 18' is remote from the collar 18' by the dimension $h_v$. Upon the opening movement of the valve needle 26', the cap 48' comes to rest, after the undamped pre-stroke $h_v$, upon the collar 18', after which the further opening movement of the valve needle 26' takes place in a damped manner as in the preceding embodiment.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection nozzle for internal combustion engines having a valve needle biased by a closing spring and opening in the flow direction of the fuel, the valve needle being connected with a piston, the upstream face end of said piston and a cap thereon defines a damping chamber filled with fuel, the chamber communicating during the opening stroke of the valve needle only via a throttle conduit with the flow course of the fuel, the cap on said piston being urged by a restoring spring in the opening direction of the valve needle, said cap coming to rest after an undamped pre-stroke of the piston with an end-rim shoulder against a blocking shoulder of the housing and subsequently thereto remaining behind in comparison with the piston that continues to move, thereby enlarging the damping chamber, wherein the restoring spring engages a spacer body pushed onto the cap, the spacer body being provided with two support shoulders axially offset from one another, of which one is oriented toward a counterpart shoulder on the cap and the other toward the blocking shoulder of the housing and which support shoulders are spaced apart axially from one another by a distance which is greater by the length ($h_v$) of the undamped pre-stroke than the axial distance between the counterpart shoulder of the cap and the end-rim shoulder thereof.

2. An injection nozzle as defined by claim 1, wherein the spacer body is a ring having two sections of different-sized diameters, at the transition from one to the other of which the support shoulder oriented toward the counterpart shoulder of the cap is formed.

3. An injection nozzle as defined by claim 2, wherein the section of the ring having the larger diameter projects over and grips a rim flange of the cap.

4. An injection nozzle as defined by claim 2, wherein the section of the ring having the larger diameter is provided with peripheral notches, between which individual support tabs are formed.

5. An injection nozzle as defined by claim 1, wherein the spacer body is a sheath provided with a bottom, the depth of the sheath being greater by the undamped pre-stroke ($h_v$) than the length of the cap.

6. An injection nozzle as defined by claim 1, wherein the spacer body is displaceably guided on the cap.

7. An injection nozzle as defined by claim 2, wherein the spacer body is displaceably guided on the cap.

8. An injection nozzle as defined by claim 3, wherein the spacer body is displaceably guided on the cap.

9. An injection nozzle as defined by claim 4, wherein the spacer body is displaceably guided on the cap.

10. An injection nozzle as defined by claim 5, wherein the spacer body is displaceably guided on the cap.

11. An injection nozzle as defined by claim 3, wherein the section of the ring having the larger diameter is provided with peripheral notches, between which individual support tabs are formed.

12. An injection nozzle as defined by claim 11, wherein the spacer body is displaceably guided on the cap.

* * * * *